US005865477A

United States Patent [19]

Ko

[11] Patent Number: 5,865,477

[45] Date of Patent: Feb. 2, 1999

[54] FAUCET FACILITATING EASY INSTALLATION ON A WALL OR TABLE TOP

[75] Inventor: Hsi-Chia Ko, Changhua Hsien, Taiwan

[73] Assignee: Chung Cheng Faucet Co., Ltd., Changhua Hsien, Taiwan

[21] Appl. No.: 903,303

[22] Filed: Jul. 30, 1997

[51] Int. Cl.[6] ..... F16L 27/00

[52] U.S. Cl. ..... 285/276; 285/351; 285/139.2; 285/204; 137/801

[58] Field of Search ..... 285/276, 351, 285/133.11, 404, 139.1, 139.2, 204, 220; 137/602, 801; 239/587.1

[56] References Cited

U.S. PATENT DOCUMENTS

| | | | |
|---|---|---|---|
| 1,226,575 | 5/1917 | Nii | 285/276 |
| 1,791,121 | 2/1931 | Cowles | 285/133.11 |
| 3,178,206 | 4/1965 | Martin et al. | 285/139.2 |
| 4,641,859 | 2/1987 | Walters | 285/351 |
| 4,792,160 | 12/1988 | Hwang | 285/351 |
| 4,884,596 | 12/1989 | Byers et al. | 137/801 |
| 5,037,140 | 8/1991 | Anderson | 285/139.2 |
| 5,165,121 | 11/1992 | McTargett et al. | 137/801 |
| 5,378,023 | 1/1995 | Olbrich | 285/351 |

*Primary Examiner*—Brian K. Green
*Assistant Examiner*—Marcus Dolce
*Attorney, Agent, or Firm*—Browdy and Neimark

[57] ABSTRACT

A fixing structure for use in a combination tap having a water discharging device, an engaging seat, a big fixing nut, a combination tap, a bolt, a nut, and two ring washers. The water discharging device is provided with a three-staged section at one end wherein three consecutive small, mid, and large stages are arranged from top to bottom defining the interior wall thereof. The upper section of the engaging seat having a protruding ring flange, two locating rib plates and two water stopper rings disposed thereon can be mounted onto the three-staged section of the water discharging device with the two water stopper rings being abutted against the small stage, the two locating rib plates against the mid-stage, and the protruding ring flange against the large stage of the three-staged section of the water discharging pipe. The outer wall of the mid-stage of the three-staged section thereof has a bolt hole through which the bolt is led and screwed up via the nut to be abutted tightly there-between the two locating rib plates of the engaging seat. In addition, the lower section of the engaging seat is provided with an outer thread section, a thread end of smaller diameter, and an inserting post whereby the lower section thereof can be engaged with the tap combination to complete the assembly of the present invention. Via the bolt and nut which can be released to loosen the abutment thereof, the water discharging device can be adjusted in any direction before being screwed up against to suit the need of different users. Moreover, the water discharging device can be of either table-type or wall-type.

3 Claims, 4 Drawing Sheets

FAUCET FACILITATING EASY INSTALLATION ON A WALL OR TABLE TOP

BACKGROUND OF THE INVENTION

The present invention is directed to a faucet for use with a combination tap, having a water discharging spout, an engaging seat, a big fixing nut, a combination tap, a bolt, a nut, and two ring washers. The water discharging spout has a three-staged section disposed at one end wherein three consecutive large, mid, and small stages are arranged from top to bottom defining the interior wall thereof, to which the upper section of the engaging seat is mounted. The lower section of the engaging seat is engaged to the combination tap. The bolt screwed up with the nut is adapted to locate and secure the engaging seat and the water discharging spout. The abutment of the bolt and the nut can be released to adjust the water discharging spout into a desirable direction before the bolt and the nut are screwed up again to relocate the water discharging spout and the engaging seat. In addition, the water discharging spout can be of either table-type or wall-type.

There are several disadvantages to a conventional fixing structure of a combination tap. For one, the assembling parts are numerous, which not only cause the difficulty of assembly but also boost the cost of production. For the other, a water discharging pipe is mounted to a housing and a base plate into one piece wherein the whole assembly must be dismantled before it is possible to adjust the direction of the water discharging pipe. It is thus quite troublesome to use such a conventional fixing structure with a combination tap.

SUMMARY OF THE INVENTION

It is therefore the primary object of the present invention to provide a faucet for use in a combination tap, comprising a water discharging spout, an engaging seat, a big fixing nut, a combination tap, a bolt, a nut, and two ring washers, wherein the assembly parts are reduce to the minimum so that the assembly is easily achieved and the cost of production is reasonably diminished.

It is another object of the present invention to provide a faucet for use in a combination tap wherein the water discharging spout has a three-staged section disposed at the interior wall of one end to which the upper section of the engaging seat is mounted. The bolt screwed up with the nut is adapted to locate and secure the engagement of the water discharging spout and the engaging seat. In addition, the abutment of the bolt and the nut can be released so as to adjust the direction of the water discharging spout into a desirable direction before the bolt and nut being screwed up again to relocate the mounted water discharging device and the engaging seat.

DETAILED DESCRIPTION OF THE PREFERRED EMBODIMENTS

Figure 1:
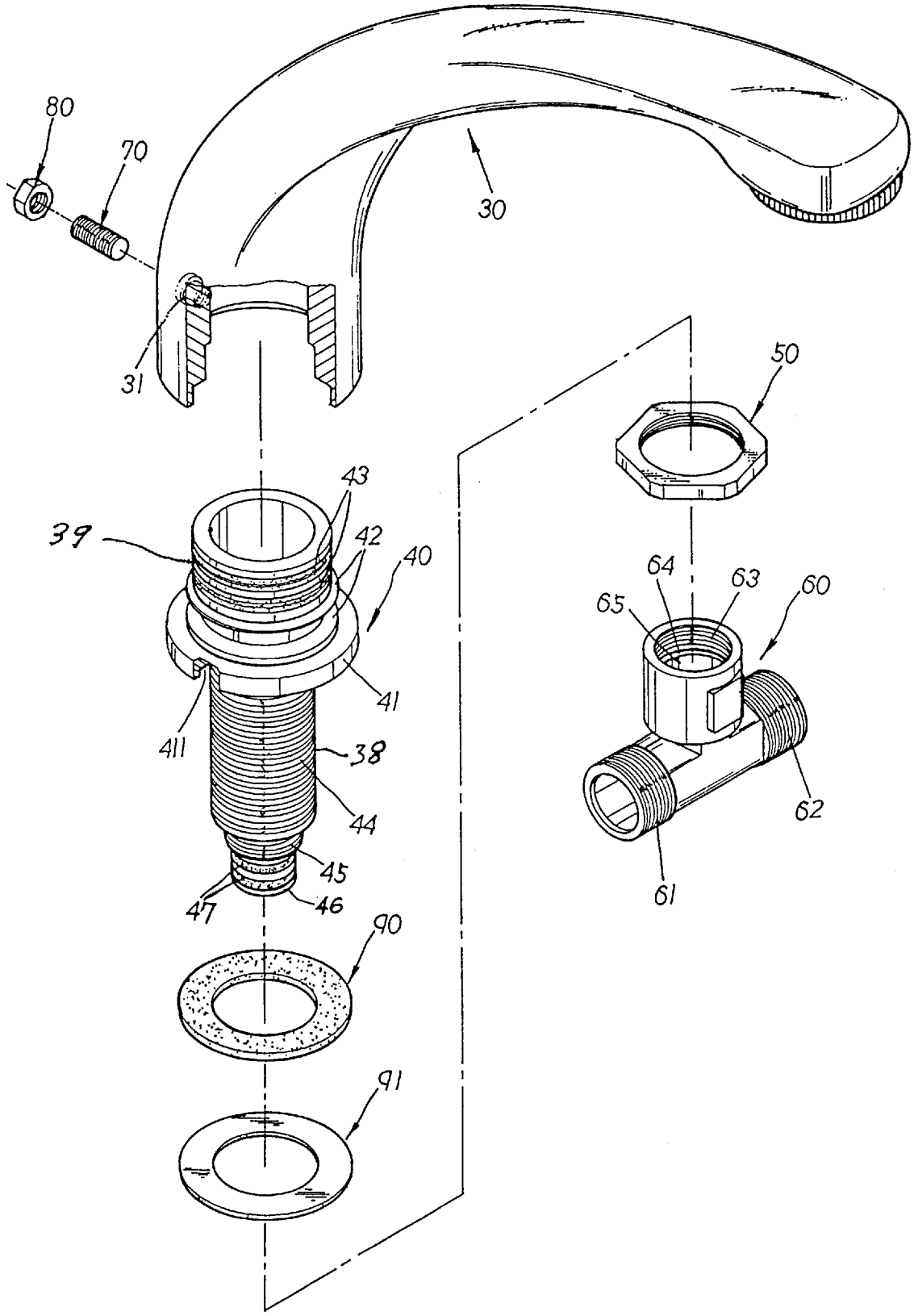
FIG. 1 is a perspective exploded view of the present invention.

Please refer to FIG. 1. The present invention relates to a faucet for use in a combination tap, having a water discharging spout 30, an engaging seat 40, a big fixing nut 50, a combination tap 60, a bolt 70, a nut 80, and a first and a second ring washers 90, 91.

The water discharging spout 30 has a three consecutive step opening with the largest opening starting at one end of the discharge spout 30 and decreasing in diameter into the spout thereafter. The three step opening defines the interior wall of spout 30. A bolt hole 31 is disposed at the outer wall of the mid-opening of the three-step opening of the water discharging spout 30, which has a bolt hole 31 of large diameter for the bolt 70 to be easily led in and secured there-through. The upper section 39 of the engaging seat 40 is provided with a protruding ring flange 41. A groove 411 is disposed defining the underside of the protruding ring flange 41. Two locating rib plates 42 are disposed at the upper side of the protruding ring flange 41 and two water stopper rings 43 are inlaid at the upper side of the two locating rib plates 42 of the engaging seat 40. An outer thread section 44 is disposed at the lower section 38 from the protruding ring flange 41 and an thread end of smaller diameter 45 is extended at the bottom end of the outer thread section 44. The bottom of the thread end of smaller diameter 45 is ended with an inserting post 46 wherein two small water stopper rings 47 are inlaid thereon. The T-shaped tap 60 has a transverse pipe having outer threads 61 or 62 disposed at each end thereon. The vertical pipe of the tap 60 is provided with inner threads 63 at the interior upper section. A tapered guiding slant 64 is disposed beneath the inner thread 63 and an inserting part of smaller diameter 65 is extended beneath the tapered guiding slant 64 thereof.

Figure 2A:
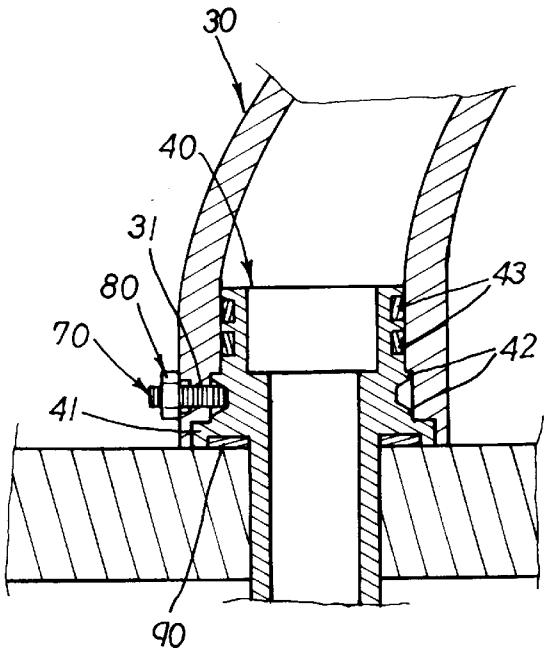
FIG. 2A is a partially sectional view showing the assembly of the upper section of the engaging seat with the three-staged section of the water discharging device.
Figure 2:
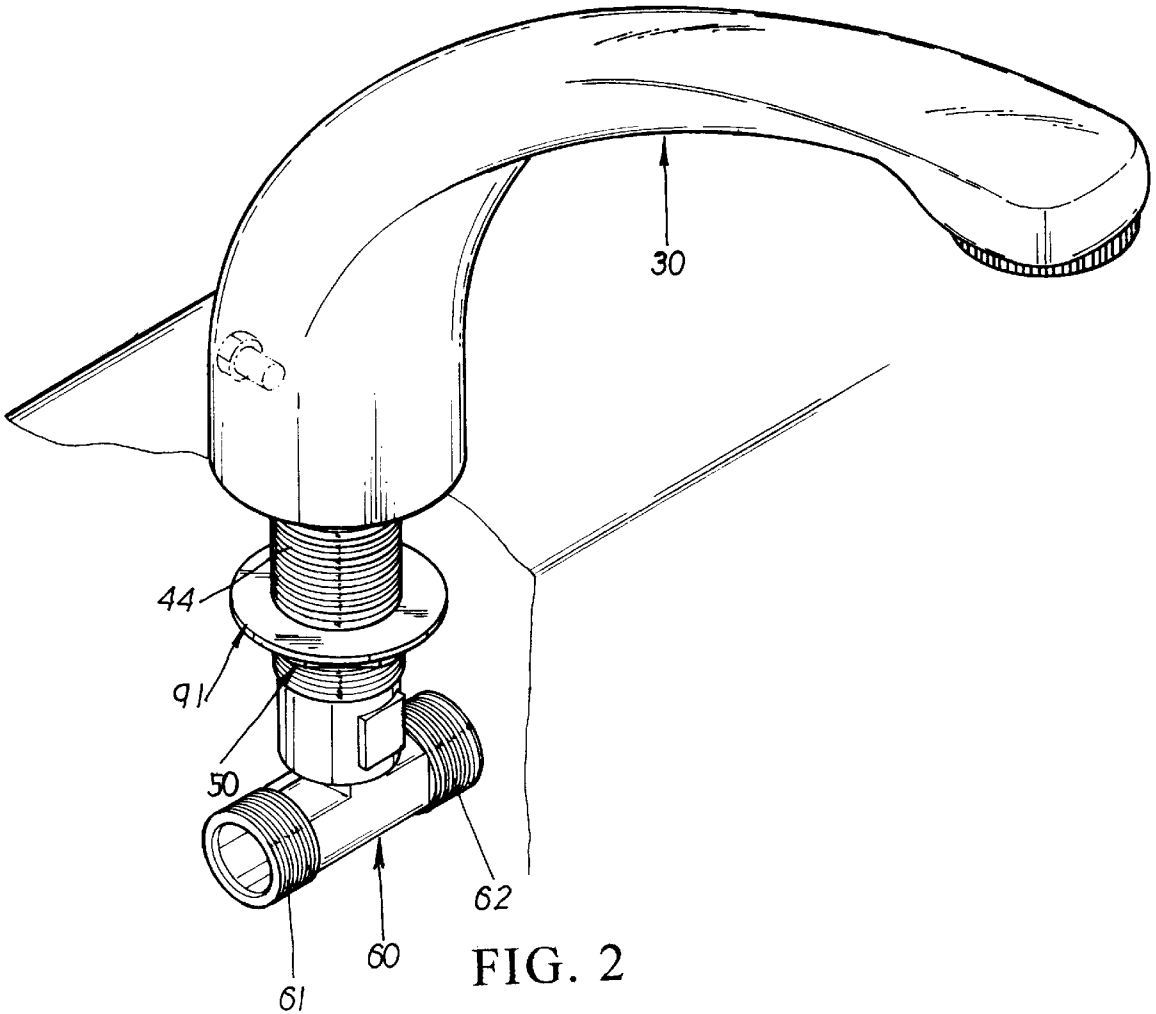
FIG. 2 is a perspective assembling view of the present invention.

Please refer to FIGS. 2, 2A. In assembly, the upper section 39 of the engaging seat 40 is mounted onto the three-step opening of the of water discharging spout 30, having the two water stopper rings 43 abutted against the walls of the small opening, the two locating rib plates 42 against the walls of the mid-opening, and the protruding ring flange 41 in the large opening of the water discharging spout 30. The bolt 70 is adapted to be led through the bolt hole 31 and, coming out at the interior wall of the mid-opening of the water discharging spout 30, located at the space defined by the two locating rib plates 42 thereof. Via a nut 80, the bolt 70 can be securely screwed up and abutted between the two locating rib plates 42 so as to further secure the engagement of the water discharging device 30 and the engaging seat 40. In addition, the screwed-up bolt 70 will prevent the water discharging spout 30 from dislocation and keep the bottom end of the water discharging device 30 evenly stable on the top of a table. The first ring washer 90 is then adapted to be inserted in the clearance defined by the groove 411 disposed at the underside of the protruding ring flange 41 of the engaging seat 40 thereof. The lower section of the engaging seat 40 is placed onto a table top 40A, having the bottom end of the engaging seat thereof coming out through a pre-set through hole 40B of the table top till the inserted first ring washer 90 is abutted tightly against the upper periphery of the pre-set-through hole 40B of the table top. The second ring washer 91 is adapted to be led through and then further secured to the outer thread section 44 of the engaging seat 40 via a big fixing nut 50 screwed up on the outer thread thereof to a bottom surface 40C of the table top 40A so as to fix the engaging seat 40 stably at the top of the table 40A. In addition, the inserting post 46 extended beneath the thread end of smaller diameter 45 can be led through the tapered guiding slant 64 disposed at the upper end of the vertical pipe of the combination tap 60, having the two small water stopper rings 47 being abutted tightly against the inserting part of smaller diameter 65 thereof to prevent the leakage of water. According to the location of the hot and cold water influx pipes, the inner thread 63 of the vertical pipe of the combination tap 60 is properly screwed up to the thread end of smaller diameter 45 of the engaging seat 40 to complete the assembly of the present invention.

Figure 3:
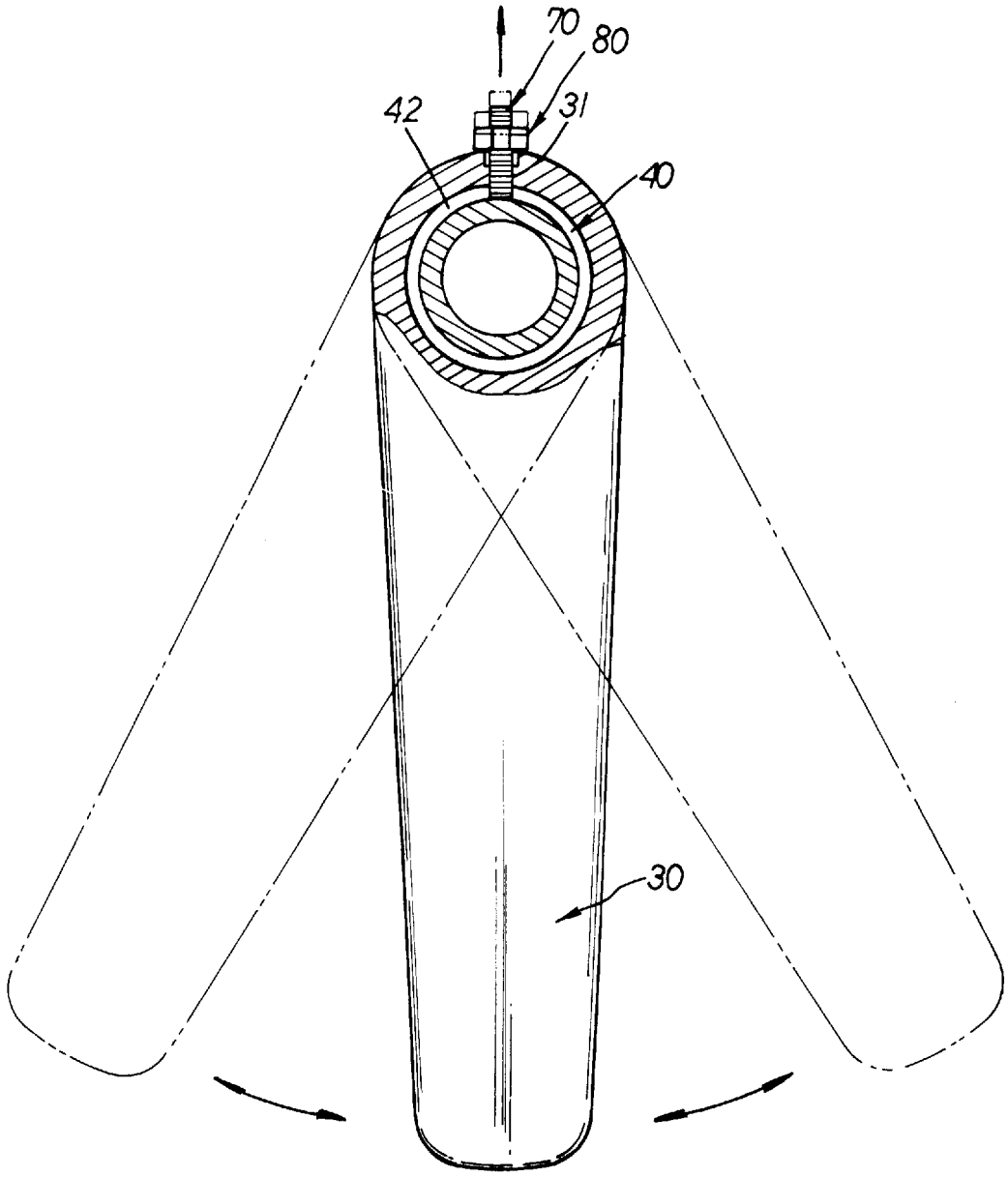
FIG. 3 is an embodiment of the water discharging device of the present invention in operation.

Please refer to FIG. 3 showing the adjustment of the water discharging spout 30 in direction. According to the need of different users, the direction of the water discharging device 30 can be easily and properly adjusted. The nut 80 securing the bolt 70 is first released to dislocate the screwed-up bolt 70 from the two locating rib plates 42 of the engaging seat 40. When the abutment of the bolt 70 is loosened, the water discharging spout 30 can then be adjusted in any direction. Once adjusted into a desirable position, the water discharging spout 30 is then relocated again with the nut 80 being screwed up again and the bolt 70 being abutted tightly between the two locating rib plates 42 of the engaging seat 40 thereof again.

Figure 4:
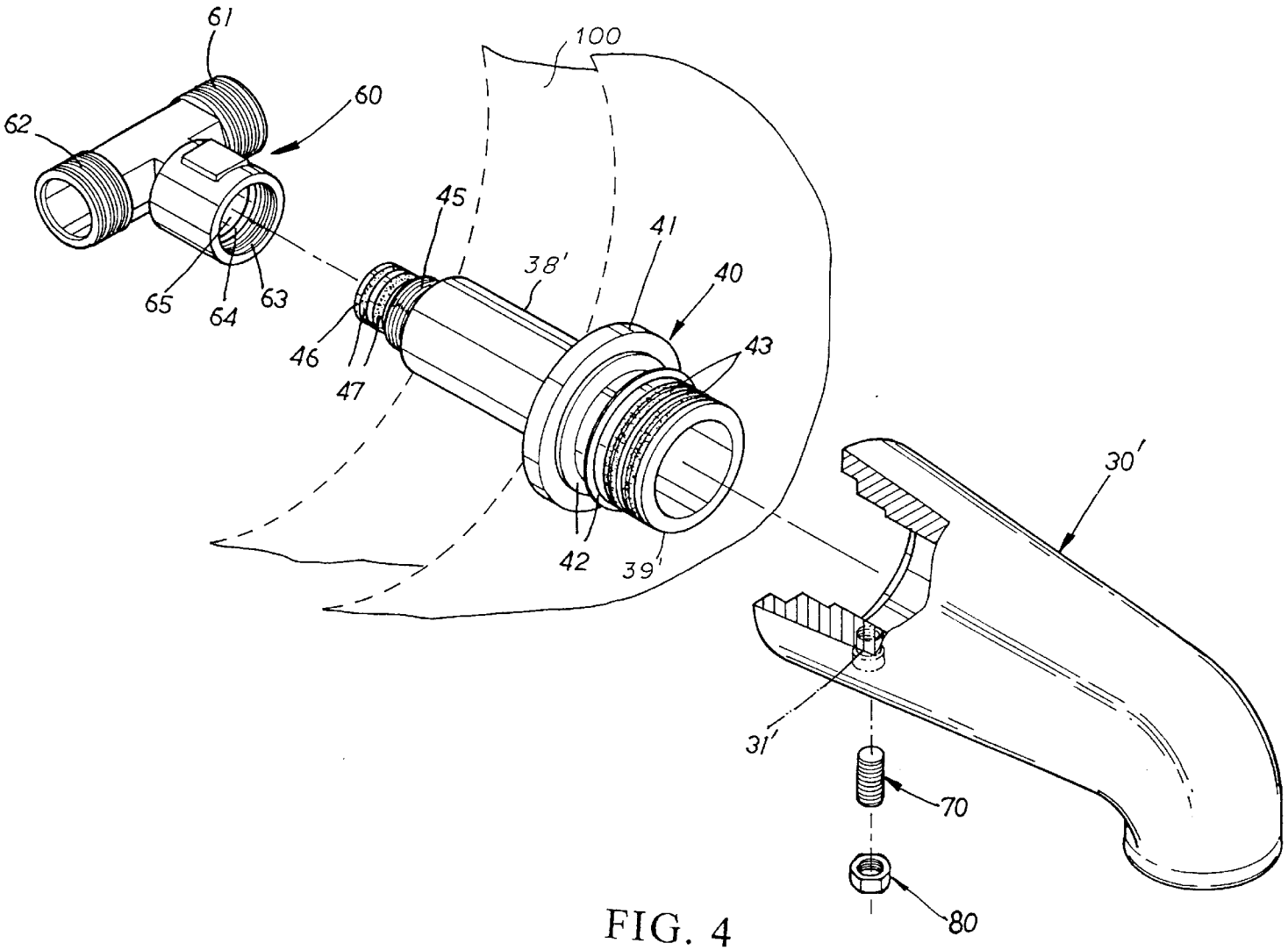
FIG. 4 is a perspective exploded view showing another embodiment of the present invention in a wall-type water discharging device.

Please refer to FIG. 4 showing another embodiment of the present invention. The fixing structure for use in a combination tap of the present invention can also be employed for a wall-type water discharging spout 30'. The wall-type water discharging device 30' is provided with a three-step opening similar to the first embodiment at the interior wall of one end matching to the upper section of an engaging seat 40. The lower section 38' of the engaging seat 40 is extended with a thread end of smaller diameter 45 and an inserting post 46 having two small water stopper rings 47 disposed thereon. The lower section of the engaging seat 40 is engaged with the combination tap 60 thereof and embeded into wall 100 with the upper section 39' thereof left out of the wall surface. A bolt hole 31' is disposed at the outer wall of the mid-opening thereof through which the bolt 70 is led and screwed up via the nut 80 to be abutted between the two locating rib plates 42 of the engaging seat 40. The nut 80 screwed up to the bolt 70 further secures the wall-type water discharging spout 30' onto the upper section of the engaging seat 40 to complete the assembly of the present invention.

By the above embodiments, there are several benefits to the present invention. First, the parts involved are reduced to the minimum and the assembly required is easily achieved. It can not only reduce the cost of production, but can also save time in assembly. Second, the water discharging devices 30, 30' can be easily adjusted to any direction to meet the need of different users and can be suited to any type of surface either a table or a wall.

What is claimed is:

1. A water discharging faucet for engagement to a table top, said water discharging faucet comprising:

a spout having at one end of said spout a three step opening, a first initial opening of said three step opening having a diameter larger than a diameter of a second opening of said three step opening, the diameter of said second opening being larger than a diameter of a third opening of said three step opening, and said three step opening defining an interior wall of said spout;

a T-shaped tap, having a transverse pipe fixed to a vertical pipe having an interior threaded upper section, a tapered guiding slanted portion extending from a bottom of said interior threaded upper section, and an insertion part having a diameter smaller than a diameter of said interior threaded upper section, said insertion part extending down from a bottom edge of said tapered guiding slanted portion, and an engaging seat having an upper section with a ring flange having a diameter corresponding to said diameter of said first initial opening, said upper section further having two spaced apart locating rib plates above said ring flange, said locating rib plates having a diameter corresponding to said diameter of said second opening, and two water stopping rings inlaid in a surface of said upper section above said two locating ribs, said two water stopping rings having a diameter corresponding to said diameter of said third opening so as to abut against a wall of said third opening, said engaging seat further having means for adjustably fixing said spout on said engaging seat when said upper section is engaged in said three step opening said means comprising a threaded through hole passing from an outer surface of said spout into said second opening, a threaded bolt corresponding to said threaded through hole which can fixedly engage said upper section at a space between said two locating rib plates and a first threaded nut corresponding to said threaded bolt to adjustably lock or release said bolt from engagement with said engaging seat and permit said spout to be fixed on said engaging seat at different positions, said engaging seat further having a first exterior threaded lower section extending down from said ring flange, a second exterior threaded lower section extending down from said first exterior threaded lower section and a third lower section extending down from said second exterior threaded lower section, said third lower section having two spaced apart stopper rings inlaid in a surface of said third lower section, wherein when said engaging seat is engaged to said T-shaped tap said second exterior threaded lower section corresponds to said interior threaded upper section of said vertical pipe and the two stopper rings tightly abut an inner periphery of said insertion part, and wherein said engaging seat is for being fixed to said table top by a second threaded nut threaded on said first threaded lower section for allowing said second thread nut to be adjustably fixed against a lower surface of said table top.

2. The faucet according to claim 1, wherein an underside of said ring flange has a groove defined thereon and a first ring washer and second ring washer are positioned on said lower section above said second threaded nut so that when said second threaded nut is fixed against said lower surface of said table top, said first ring washer is for being engaged against said table top and said second ring washer is for being engaged against the lower surface of said table top.

3. A water discharging faucet for engagement to a wall, said water discharging faucet comprising:

a spout having at one end of said spout a three step opening, a first initial opening of said three step opening having a diameter larger than a diameter of a second opening, of said three step opening, the diameter of said second opening being larger than a diameter of a third opening of said three step opening, and said three step opening defining an interior wall of said spout;

a T-shaped tap, having a transverse pipe fixed to a vertical pipe having an interior threaded upper section, a tapered guiding slanted portion extending from a bottom of said interior threaded upper section, and an insertion part having a diameter smaller than a diameter of said interior threaded upper section, said insertion part extending down from a bottom edge of said tapered guiding slanted portion, and an engaging seat having an upper section with a ring flange having a diameter corresponding to said diameter of said first initial opening, said upper section further having two spaced apart locating rib plates above said ring flange, said locating rib plates having a diameter corresponding to said diameter of said second opening, and two water stopping rings inlaid in a surface of said upper section above said two locating ribs, said two water stopping rings having a diameter corresponding to said diameter of said third opening so as to abut against a wall of said third opening, said engaging seat further having means for adjustably fixing said spout on said engaging seat when said upper section is engaged in said three step opening said means comprising a threaded through hole passing from an outer surface of said spout into said second opening, a threaded bolt corresponding to said threaded through hole which can fixedly engage said upper section at a space between said two locating rib plates and a first threaded nut corresponding to said threaded bolt to adjustably lock or release said bolt from engagement with said engaging seat and permit said spout to be fixed on said engaging seat at different positions, said engaging seat further having a first lower section extending down from said ring flange, a second exterior threaded lower section extending down from said first lower section and a third lower section extending down from said second exterior threaded lower section, said third lower section having two spaced apart stopper rings inlaid in a surface of said third lower section, wherein when said engaging seat is for being engaged to said T-shaped tap said second exterior threaded lower section corresponds to said interior threaded upper section of said vertical pipe and the two stopper rings tightly abut an inner periphery of said insertion part, and wherein said engaging seat is fixed to said wall by engaging said faucet to said engaging seat.

* * * * *